US006163934A

United States Patent [19]

Crespo Fuster

[11] Patent Number: 6,163,934

[45] Date of Patent: Dec. 26, 2000

[54] MULTI-PURPOSE PAPER CLIP

[76] Inventor: Damaso Crespo Fuster, 109 Ludlow St., Apartment A, New York, N.Y. 10002

[21] Appl. No.: 09/245,482

[22] Filed: Feb. 8, 1999

[30] Foreign Application Priority Data

Feb. 6, 1998 [ES] Spain ..... 9800338 U

[51] Int. Cl.[7] ..... A44B 21/00; B42F 1/00

[52] U.S. Cl. ..... 24/67.9; 24/552; 24/546; 24/547

[58] Field of Search ..... 24/67.9, 546, 547, 24/552, 555, 598.6

[56] References Cited

U.S. PATENT DOCUMENTS

| | | | |
|---|---|---|---|
| 1,510,380 | 9/1924 | Bracken | 24/546 |
| 2,239,584 | 4/1941 | Zane | 24/552 |
| 2,240,693 | 5/1941 | Elnes | 24/552 |
| 2,546,303 | 3/1951 | Holle | 24/67.9 |
| 3,494,071 | 2/1970 | Simmon | 24/547 |
| 4,665,594 | 5/1987 | Wagner . | |
| 5,063,640 | 11/1991 | Link . | |

FOREIGN PATENT DOCUMENTS

| | | | |
|---|---|---|---|
| 511 965 | 1/1921 | France . | |
| 2680481 | 2/1993 | France . | |
| 179772 | 12/1935 | Switzerland . | |
| 0000765 | 3/1875 | United Kingdom | 24/598.6 |
| 2304788 | 3/1997 | United Kingdom . | |

*Primary Examiner*—Victor N. Sakran
*Attorney, Agent, or Firm*—Baker & Botts, L.L.P.

[57] ABSTRACT

A multi-purpose paper clip formed of a strand of flat cross section of a resilient material has a first loop portion and a second loop portion that are joined by mutually crossing portions, the first loop portion and second loop portion being of the same hand relative to either crossing portion and being spaced apart in opposed relation so as to form bights facing the crossing portions and each other.

8 Claims, 1 Drawing Sheet

MULTI-PURPOSE PAPER CLIP

BACKGROUND OF THE INVENTION

The present invention relates to a multi-purpose paper clip and, more particularly, to a multi-purpose paper clip that provides significant improvements in performance, as compared with previously known paper clips, and can carry out entirely new functions.

There exist numerous known types of paper clips, most of which are made of a metal wire of round cross-section and with some degree of resiliency that is bent into various shapes to produce two branches, which are bendable simultaneously in opposite directions such that one branch engages the top sheet of a group of sheets being bound and the other branch engages the bottom sheet. The two branches are relatively close to one another and are joined by a relatively short juncture portion, which is generally a semi-circular loop having a relatively small radius of curvature. The small distance of separation between the branches and the small size of the juncture loop results in a concentrated area of bending along the juncture loop, which is subject to high torsion forces distributed along its relatively short length. When the conventional paper clip is applied to a thick group of sheets, the elastic limit of the wire from which the paper clip has been made is exceeded, which causes it be permanently deformed and to thereafter exert very little binding force on the group of sheets to which it is applied. Another deficiency of previously known paper clips results from the fact that the wire material from which they are made is of circular cross section. There is only line contact between the branches and the sheets that the branches engage, which in turn results in relatively low frictional force. In addition, the ends of the round wire at the region of line contact produce sharp and pointed edges that can easily mar or tear the paper upon removal of the clip.

Previously known clips, which are generally applied to a part of the corner of a stack of paper sheets, necessarily occupy a considerable amount of space if they are to have a sufficient grip on the stack. If they are placed very close to the edge of the stack, it is easy to dislodge them as pages are turned back to allow examination of the contents of the same. Therefore, it is relatively inconvenient to bind the sheets of paper with previously known paper clips, owing to the fact that the clip must often be situated in the corner over a part of the text which is contained on the pages in order to achieve a secure engagement between the paper clip and the paper.

SUMMARY OF THE INVENTION

An object of the present invention is to provide a multi-purpose paper clip that has increased gripping engagement with a medium to which it is affixed, that resists permanent deformation when used to bind a relatively thick stack of sheets or some other medium, is not prone to damaging the medium to which it is affixed and is versatile, thus to be capable of many uses.

The foregoing object is attained, in accordance with the present invention, by a multi-purpose paper clip formed of a resilient strand that has a first loop portion and a second loop portion. The loop portions are joined by mutually crossing portions. The first loop portion and second loop portion are of the same hand relative to either crossing portion and are spaced apart in opposed relation so as to form bights that face the crossing portions and each other.

In preferred embodiments, the strand includes portions having cross sections forming flat surfaces that are located so as to engage a medium to which the multi-purpose paper clip is affixed, the loop portions and the crossing portion are shaped to resemble a figure "8" or the symbol for infinity, "∞" (which is essentially a form of a figure "8"), and the strand has ends that are located proximate to each other at a lateral extremity of one of the loop portions.

A multi-purpose paper clip according to the present invention overcomes the aforementioned inadequacies of previously known paper clips owing, in part, to the fact that each of the two loop portions has a bight that fits over the edge of the paper stack or other medium so that the bight of each loop produces a binding effect by being stressed resiliently by bending of the bight between a part of each loop portion that overlies the stack and a part of each loop portion that underlies the stack. The length of the stressed bight of each loop portion is relatively large, as compared to the single semi-circular loop of the conventional paper clips, thus distributing the bending stresses over a relatively long part of each loop portion. Engagement of the clip with a medium by two loop portions, each of a relatively long length, effects a considerably better retention of a larger number of sheets of paper due to the application of forces by two loop portions acting at spaced-apart zones.

Furthermore, the width of the space in the region of the corner on the top sheet which is engaged by a clip according to the present invention is much less than that engaged by a securely installed conventional paper clip, which, together with the fact that the clip achieves a greater grip, owing to a larger area of engagement and a stronger resilient force, facilitates the manipulation of the pages without any impediment to the thorough examination of the contents of the same without the clip releasing its grip on the stack of sheets.

The aforementioned advantages are achieved by a clip constituted by a thin band of resilient material, which is preferably flat in cross section, at least in some parts along its length, and is closed over itself such that the opposing loop portions are joined by overlapping crossing portions at approximately a mid-point. The clip is, preferably, in the general shape of the figure "8" but with the possibility of forming the figure "8" with straight portions along selected parts of each of the loop portions. The flat form of the clip in cross section endows it with a greater resilient force, such that, apart from having a greater surface area of contact, it has a greater bending strength than a wire with a round cross section.

The ends of the flat strand or band bent into the generally figure "8" shape lie closely adjacent each other face to face, preferably with a small gap so that they do not contact each other. The gap between the ends, which preferably is located close to the lateral extremity of one of the loop portions, permits the loop portion in which the gap is located to be opened up to accept a stack of paper or other medium between parts of that loop portion on either side of the gap and with the bight of the other loop portion spaced apart from the edge of the medium, leaving a gap that enables the clip to be used as a hanger.

As described below, it is possible to have the ends of the band connected. Furthermore, when used as a clip for a stack of paper, the ends of the band at the gap are not prone to marring or tearing the paper, because they are close together, lie in the same plane, and do not disrupt the continuity of the surfaces of the clip that engage the paper and because those surfaces, in preferred embodiments, are flat.

For a better understanding of the invention, reference may be made to the following description of an exemplary embodiment, taken in conjunction with the accompanying drawings.

DESCRIPTION OF THE EMBODIMENT

Figure 5:
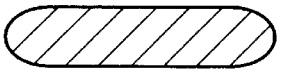
FIG. 5 is a cross-sectional view of a strand from which the clip is formed.

The multi-purpose paper clip 1, is formed from a single band of resilient materials, such as metal or plastic, having a flat cross section (see FIG. 5), thus presenting planar surfaces for engagement with a stack of paper sheets or some other medium to which the multi-purpose paper clip is affixed. The band has sufficient resiliency to provide a firm gripping force on opposed surfaces of the medium that it engages. A preferred cross section of the band, as shown in FIG. 5, is bounded by flat, parallel top and bottom surfaces that are joined by rounded side edges.

Figure 1A:
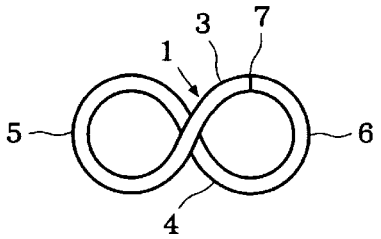
FIGS. 1A and 1B are top and bottom plan views of the embodiment.
Figure 1B:
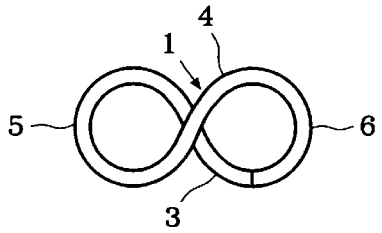
Figure 3:
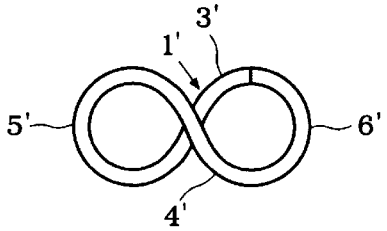
FIG. 3 is a view of the same clip as is shown in FIGS. 1A, 1B and 2, but with the two loop portions being of the opposite hand from those of the clip of FIGS. 1 and 2.

The multi-purpose paper clip has two branches 5 and 6, each in the form of a geometrically closed loop. Each loop may be substantially circular or oval-shaped. The two loop portions 5 and 6 of the illustrated embodiment are of the same size and shape and are joined by mutually overlapping crossing portions 3 and 4. The respective loop portions 5 and 6 of a clip may be of different sizes or of different shapes, if desired. With respect to either of the crossing portions 3 and 4, the loop portions 5 and 6 are of the same hand and are oriented in opposed relation with their bights facing the crossing portions and each other. In particular, and with reference to FIG. 1A, each loop portion 5 and 6 progresses clockwise from the crossing portion 3 to the crossing portion 4, and each loop portion 5 and 6 progresses counterclockwise from the crossing portion 4 to the crossing portion 3. As a comparison of FIGS. 1A and 1B with FIG. 3 illustrates, the loop portions can be either right hand or left end, with respect to the overlying or top crossing portion. In side elevation (not shown) the clip 1 is substantially planar, but taking into account a slight displacement of one loop portion relative to the other out of an exact planar relation because of the overlapping of the crossing portions 3 and 4.

Figure 4:
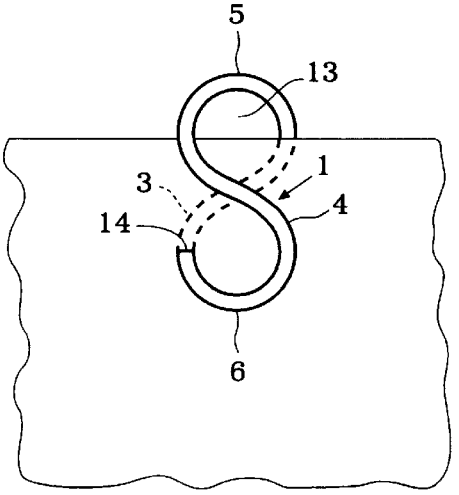
FIG. 4 shows an additional function of the clip, namely as a hanger for one or more sheets of paper or many other items.

The ends of the strand forming the clip 1 are located proximate to each other at a point 7 at the lateral extremity of one of the loop portions 5 and 6. It is possible to join the ends of the strand at the point 7, but it is preferred to leave a small gap between the ends so that it is possible for separation of the loop portion in which the end point or gap 7 occurs in order to accomplish the function of a hanger, which is shown in FIG. 4 and described below. If desired, the ends of the band at the meeting point 7 can be soldered, welded or adhesively bonded to join them. For most purposes the gap 7 plays no role in the function of the clip.

Figure 2:
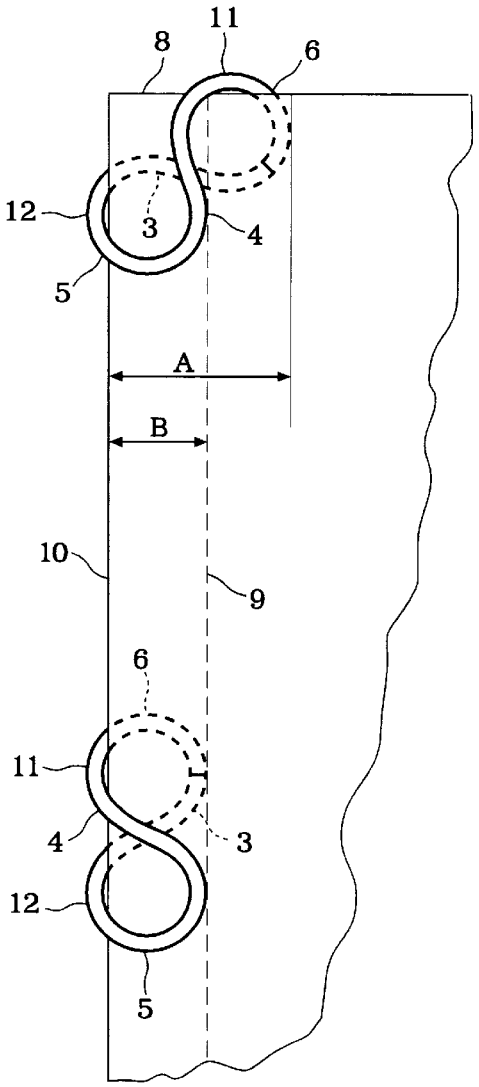
FIG. 2 shows two of the multi-purpose paper clips of FIGS. 1A and 1B affixed to a stack of sheets, only an edge portion of the stack of sheets being shown.

FIG. 2 shows two examples of the use of the clip of FIG. 1 as a binder for a stack of papers. When it is desired, for example, to bind a stack of papers by the corner 8, the clip is applied in the manner shown; i.e., in a manner in which its longitudinal mid-point axis (a line connecting the opposite extremities of the bights of the loop portions 5 and 6) lies obliquely such as to form approximately an angle of 45 degrees with each of the sides of the stack of sheets meeting at the corner. It will be seen that the total width, in the transverse direction, of the gripping zone, which is the dimension marked with the letter A in FIG. 2 and corresponds to the width occupied by the parts of the loop portions 5 and 6 situated on the underside of the paper stack, is relatively large, thus providing a strong gripping action of the part of the clip that does not interfere with turning back the sheets at the corner. The extent of the area of the corner of the paper stack engaged by the clip on the top of the stack, on the other hand, is approximately one half of the dimension A, namely, the area having the dimension marked by the letter B in FIG. 2. Thus the front of the clip does not interfere with turning back the pages.

In addition and very importantly, because of the curved form of the loop portions of the clip and the presence of two bights 11 and 12 that pass over the edges of the paper stack from front to back and enable parts of each loop portion to lie on opposite surfaces of the paper stack, there are two regions of the clip—the bights 11 and 12—that are resiliently stressed and apply gripping forces to the paper stack. Also, the total area of engagement between the clip and the paper stack—measured at the extremities of the area of engagement—is considerably greater than in the case of conventional paper clips, all of which have straight, relatively narrow gripping branches.

As the drawings clearly show, the clip is normally (except, for example, when used as a hanger as shown in FIG. 4) applied to a medium, such as a stack of paper, by sliding the edge of the medium between the loop portions such that one crossing portion 3 lies on one side of the medium and the other crossing portion 4 lies on the other side. The gap 7 and the parts of the loop portion 6 adjacent the gap lie entirely on one side of the medium. The clip is easily applied by engaging the medium under one loop portion 5 and tilting the clip slightly to enable the other loop portion 6 to be slid underneath the medium.

FIG. 2 also shows a second clip 1 applied in a location intermediate of the upper left and lower left corners of the stack of paper sheets. With the ability to apply another identical clip in an intermediate position, and finally, another in the lower left corner (not shown) in the same manner as that shown in the top left corner, the organization of a stack of papers in book fashion is achieved, and the sheets can be bent along the length of line 9 relatively close to edge 10, which is to say, corresponding to dimension B, which is appropriately within the space used for normal margins of printed material. In a manner similar to that shown in FIG. 2, two or more clips 1 can be applied along any edge or all edges of a stack of material to secure them.

FIG. 3 shows a clip 1' in which the loop portions 5' and 6' are left handed—i.e., progress counterclockwise with respect to the overlying crossing portion 4'. The manner of use of this clip is practically identical to the clip 1 of FIGS. 1 and 2 and can be used, for example, for binding a paper stack along the upper edge in analogous fashion to the left edge as shown in FIG. 2.

It is to be noted that the bights 11 and 12 of the loop portions of the clip are spaced relatively far apart and are of relatively large curvatures so that the ability of the clip to be opened up enables the clip to efficiently hold a greater number (larger stack) of pages in any of the positions of the clip's application, an effect which is augmented by the act of subjecting the group of papers to a double twisting force or curvature, coinciding with zones 11 and 12, as is most particularly appreciable in the lowest clip of FIG. 2.

FIG. 4 shows a further application for the clip, namely as a hanger for one or more sheets of paper or some other objects. The object to be hung by the clip is introduced through the gap 7 between the ends of the band, which is separated laterally so as to accept the clip in a vertical position, leaving an opening 13 between the upper edge of the medium and the loop portion 5 that is large enough to accept a nail or a push pin or other suspension element. In this case, an end 14 of the clip at the gap 7 faces upwardly, and the part of the clip that engages the front face of the paper stack, which will have twisted slightly inwardly upon introducing the object, together with the pressure applied by the mutually crossing portions of the clip, provide a strong grip on the paper and prevent slippage of object downwardly, even when a relatively strong downward force is applied to them.

To those who utilize a clip embodying the present invention, numerous other applications may occur to them, for example, as links to form a chain of whatever length, a fastener for string or cloth (for example, to affix a personal/name card to the pocket of a shirt), as a decorative hanger, alone or in unlimited combination with other clips, making infinite designs, such as to frame photos or cards, as a placeholder or marker in the text of a book, or as well for placeholder earmarks/subject dividers in a binder, as a decorative clip, for example on ties, and numerous other uses. The shape of the clip makes it much more attractive esthetically than previously known clips, such that it is, indeed, not only highly useful but a beautiful object of design.

What is claimed is:

1. A multi-purpose paper clip formed of a continuous resilient strand having ends and formed so as to have a first loop portion and a second loop portion that are joined by mutually crossing portions, the first loop portion and second loop portion being of the same hand relative to either crossing portion and being spaced apart in opposed relation so as to form bights facing the crossing portions and each other and the ends of the strand being located in one of the loop portions and remote from the bight of said one loop portion and being proximate to each other so as to leave a small gap at a butt joint between the ends.

2. A multi-purpose paper clip according to claim 1, wherein the strand includes portions having cross sections forming flat surfaces adapted to engage a medium to which the multi-purpose paper clip is affixed.

3. multi-purpose paper clip according to claim 1, wherein the ends are located substantially at a lateral extremity of one of the loop portions.

4. A multi-purpose paper clip according to claim 1, wherein the loop portions and the crossing portion are shaped to resemble a figure "8."

5. A multi-purpose paper clip according to claim 1, wherein the strand is a band of uniform cross-section throughout and has flat surfaces adapted to engage a medium to which the multi-purpose paper clip is affixed.

6. A multi-purpose paper clip according to claim 5, wherein the ends are located substantially at a lateral extremity of said one of the loop portions.

7. A multi-purpose paper clip according to claim 6, wherein the loop portions and the crossing portion are shaped to resemble a figure "8".

8. A multi-purpose paper clip according to claim 5, wherein the loop portions and the crossing portion are shaped to resemble a figure "8."

* * * * *